United States Patent [19]

Sunnen

[11] 4,127,190

[45] Nov. 28, 1978

[54] DISPENSER FOR DISPENSING PILLS OR TABLETS IN A PREDETERMINED ORDER

[75] Inventor: Robert M. Sunnen, St. Louis County, Mo.

[73] Assignee: The Emko Company, St. Louis, Mo.

[21] Appl. No.: 750,172

[22] Filed: Dec. 13, 1976

[51] Int. Cl.[2] ..... B65D 83/04

[52] U.S. Cl. ..... 206/535; 206/538; 221/2; 116/121

[58] Field of Search ..... 221/2, 4, 5, 69, 82, 221/83, 89, 91, 92, 97, 119–121; 222/548, 142.6–142.9; 206/534, 535, 536, 538, 528, 539, 533; 116/121

[56] References Cited

U.S. PATENT DOCUMENTS

| | | | |
|---|---|---|---|
| 243,925 | 7/1881 | La Bau | 206/535 |
| 2,577,344 | 12/1951 | Masure | 221/97 |
| 2,953,242 | 9/1960 | Shaw | 206/534 |
| 3,358,818 | 12/1967 | Davis | 206/538 |
| 3,561,592 | 2/1971 | McCool | 206/534 |
| 3,921,806 | 11/1975 | Wawracz | 206/534 |

FOREIGN PATENT DOCUMENTS

| | | | |
|---|---|---|---|
| 161,145 | 9/1920 | United Kingdom | 206/536 |

*Primary Examiner*—Robert B. Reeves
*Assistant Examiner*—H. Grant Skaggs
*Attorney, Agent, or Firm*—Charles B. Haverstock

[57] ABSTRACT

A dispenser for dispensing pills or tablets in a predetermined sequential order, including a pill container, a dispensing cap, and sequence indicating indicia associated therewith. The container is a cylinder, preferably transparent, having spaced annularly arranged bores extending thereinto from a first end thereof, with each of the bores adapted to hold a predetermined number of pills or tablets arranged in a single column therein. A dispensing cap fits over the first end of the container and engages with the container to be rotatable thereon and is adapted so that as it is rotated on the container each of the annularly arranged bores is accessed in an annular sequence to permit the pills or tablets within the accessed bore to be sequentially individually dispensed therefrom. Indicia denoting the number and sequence in which pills are dispensed are associated with the container so as to instruct and remind the user of the times at which the pills or tablets should be taken and to allow the user to confirm that he has not inadvertently failed to take a pill or tablet at the required time. Such indicia may be inscribed or otherwise applied on the container or may appear on an insert positioned in a centrally located bore extending through the container, which insert may optionally be retained in the container by a second cap member that fits over the opposite end of the container from the dispensing cap.

20 Claims, 5 Drawing Figures

DISPENSER FOR DISPENSING PILLS OR TABLETS IN A PREDETERMINED ORDER

This invention relates to a pill dispenser and, in particular, to a refillable dispenser with pill-time correspondence indicators for dispensing prepackaged pills at spaced time intervals in a predetermined sequential order from a plurality of pill holding compartments.

Frequently, when an individual is taking medication he or she must take the medication at spaced intervals over some extended period of time. Typical of such users are the chronically ill who take medication to control their illness and ease their pain, women who take birth control pills, and the elderly who must take dietary or hormonal supplements. Many of these users continue to use single compartment pill containers of the type which are typically provided by a druggist and in which no provision is made for the orderly dispensing of the medication on a schedule over an extended period. Other users, because they must take a variety of medications, prefer segmented containers, such as the type found in U.S. Pat. No. 1,896,976, which segregates the different types of medication but is not adapted to hold the medication in an ordered arrangement to be sequentially dispensed in accordance with a preset medication schedule. If the individual must take more than one kind of medication, if the dosage level or type of medication prescribed varies according to the time it should be taken, or if the spaced intervals between administration of the medication are somewhat irregular, the individual may have difficulty in remembering and determining which medication to take at what time, and may even, on occasion, forget to take the medication required and thereafter be unable to ascertain which, or even whether, any medication has been missed. A number of attempts have been made to develop dispensers for use in sequentially dispensing medicaments in pill or tablet form that will conveniently allow the user to quickly determine when the last pill or tablet was dispensed and when the next pill or tablet should be taken. All, including such devices as are found in U.S. Pat. Nos. 3,921,806, 3,261,455, and 2,953,242, have suffered from various shortcomings, such as requiring a large number of separate pill compartments thereby increasing the surface area of the container thus making the container inconvenient to store; requiring intricate and cumbersome means of accessing and dispensing a compartmented pill or tablet thereby increasing the complexity of the device and requiring added parts; requiring elaborate means to move the pills or tablets around in the container thereby increasing the likelihood that the pills will be broken thus damaging the pill and jamming the pill movement means; failing to sequentially order pills within a compartment thereby resulting in an inability to ensure that a single, proper pill will be dispensed therefrom when the compartment is next accessed; failing to provide a user cognizable pill-time correspondence thereby resulting in an inability of the user to easily determine if or when a pill was last taken; failing to provide any way in which the user can quickly and easily refill the dispenser for re-use thereby resulting in uneconomical one time usage by an individual with the attendant increased cost thereof. All of the known pill dispensers suffer one or more of these disadvantages. The present invention overcomes these and other disadvantages and at the same time allows the user to quickly determine when the last pill or tablet was dispensed, when the next pill or tablet should be taken, and which of the pills in the container should next be dispensed, and it does so by a container having fewer parts, less complexity, and at a lower cost.

Briefly, the present invention resides in a pill dispenser including a cylindrical container with a plurality of spaced annularly arranged bores extending thereinto from the top end thereof to hold a predetermined number of pills or tablets to be vertically stacked therein to thereafter be sequentially dispensed therefrom in an order proceeding from top to bottom thereof when the bore is accessed for dispensing, indicia associated with the container indicating the sequence in which the pills are to be dispensed, and a cap means which fits over the top end portion of the container and which engages therewith to be rotatable thereon to position the cap to permit the pills in a bore accessed by the rotation of the cap to be individually sequentially dispensed and to thereafter be further rotatable to access each of the remaining bores in turn in annular sequence to permit the pills therein to be dispensed such that all the pills are dispensed in accordance with a plan which is arranged and sequenced by the indicia on the container.

Accordingly, it is a primary object of the present invention to provide a pill dispenser for dispensing prepackaged pills or tablets in a predetermined sequential order.

Another object is to make it easy for persons who take medication on a schedule to keep track of the schedule and to verify that they have been following the schedule.

Another object is provide a relatively simple and trouble free pill dispenser which has few moving parts and can be operated by persons having little training or ability.

Another object is to relieve persons on medication from the burden of keeping track of when to take medication and what medication to take.

Another object is to reduce the possibility of a person on medication taking the wrong medication or the wrong dosage.

Another object is to make possible more complicated schedules for taking medication with greater expectation that the schedules will be followed.

It is a further object to provide a pill dispenser that conveniently indicates to the user when the last pill or tablet was dispensed and when the next pill or tablet should be taken.

A still further object of the present invention is to provide a pill dispenser that is convenient to handle and carry and one which can be conveniently stored on the shelf of a medicine cabinet.

Another object of the present invention is to provide a pill dispenser that may be pre-loaded with a predetermined number of pills or tablets to be dispensed in a particular sequence.

A still further object is to provide a pill dispenser of few parts that can be economically produced.

Another object is to provide a pill dispenser that is reusable and that may be quickly and easily refilled.

These and other objects and advantages of the present invention will become apparent after considering the following detailed specification in conjunction with the accompanying drawing, wherein.

Figure 1:
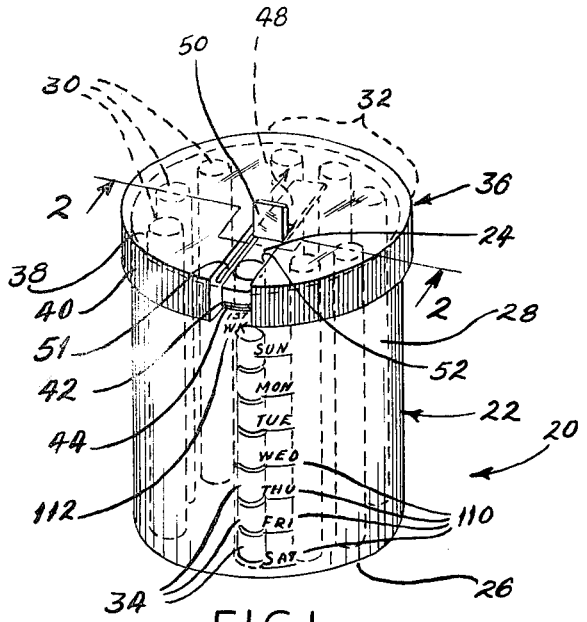
FIG. 1 is a perspective view of one embodiment of a pill dispenser constructed according to the present invention.
Figure 3:
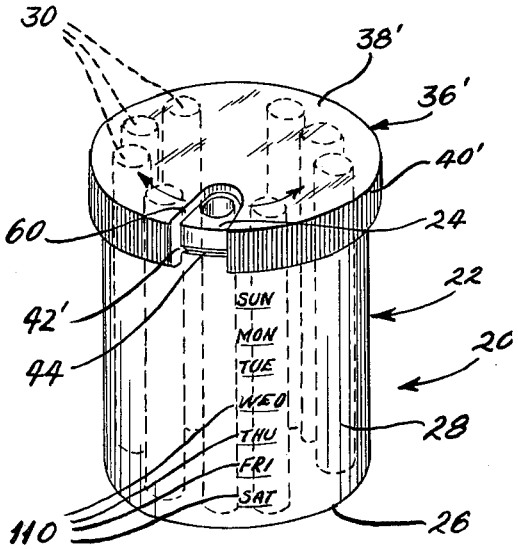
FIG. 3 is a view similar to FIG. 1, but showing an alternative embodiment of the container cap means.
Figure 5:
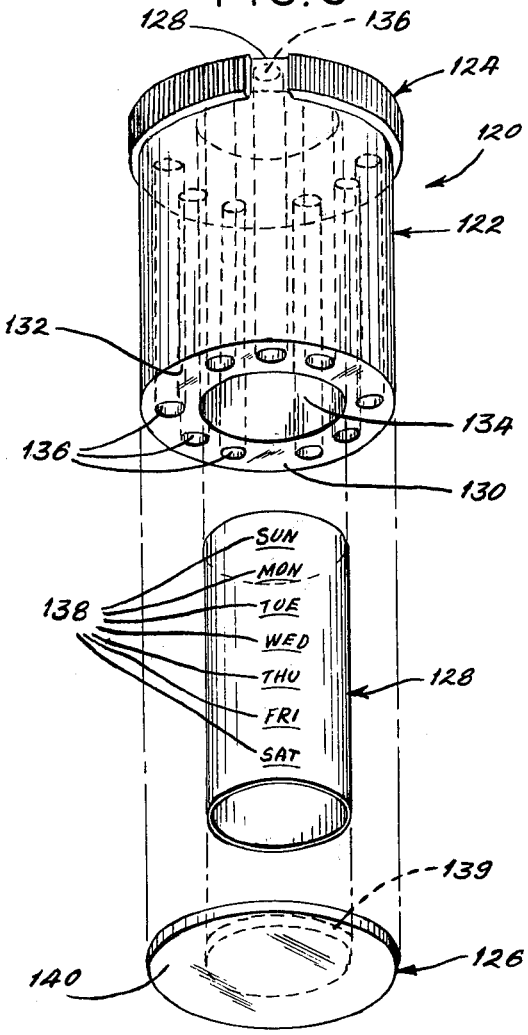
FIG. 5 is an exploded perspective view of still another embodiment of a pill dispenser constructed according to the present invention.

Referring to the drawing more particularly by reference numbers, number 20 identifies a pill dispenser constructed according to the present invention. The dispenser 20 includes a cylindrical container body portion 22 having a top end surface 24 and a bottom end surface 26 joined by an outer annular wall surface 28. A plurality of spaced annularly arranged counterbores 30 (positions for nine being shown) extend into the body portion 22 from the top surface 24 thereof. As shown in FIGS. 1, 3 and 5, the counterbores 30 may be arranged in groupings, such as bore grouping 32, and the space between groupings may be somewhat greater than the space between the individual bores 30 within the groupings. Each of the counterbores 30 is preferably adapted to conform to the shape of the pills or tablets to be placed therein and each counterbore is adapted such that pills to be placed therein will be arranged in a stacked condition or in a vertical column therein, as are pills 34.

The container 22 is preferably, but not necessarily, made of a transparent material so that the user can see the pills 34 stacked in each of the counterbores 30 through the outer annular wall surface 28, and it is preferably constructed of a durable material, such as a plastic material able to withstand moderate impact and normal usage. A relatively hard plastic or an impact-resistant glass can be used for this purpose.

A cap means, such as cap 36, is adpated to fit over the top end portion including over the top surface 24 of the container 22 and to cooperatively engage with the container body 22 to be rotatable thereon. The cap 36 shown in FIG. 1 has a round flat upper wall portion 38 with a depending nearly annular flange portion 40 extending downwardly therefrom about the outer periphery of the wall portion 38. An inwardly extending flange 42 projects from the depending flange portion 40 of cap means 36 to cooperatively engage with an inwardly directed annular groove 44 formed in the outer wall surface 28 of the container 22 to hold the cap means 36 in snap fit engagment with the container 22 and yet permit rotational movement thereof.

A closure member 48 with an upwardly projecting tab 50 is positioned for sliding engagement with track means 51 formed by and in a groove or slot 52 in the upper wall portion 38 of cap means 36. The closure member 48 makes frictional engagement with the track means 51 but can be moved on the cap 36 between an open position, as shown in FIG. 1, wherein an opening is formed which can be registered with a selected one of the counterbores 30, and a closed position, wherein the member 48 closes the slot 52 and prevents access to any of the bores 30. The slidable member 48 may be retracted and extended by applying force to the tab 50 in the desired direction to move it between its open and closed positions. When force is applied to move the tab 50 towards the outer periphery of the upper cap portion 38 the member 48 is extended to cover the top end portion 24 of the container 22 and to conceal the counterbores 30 extending thereinto, thereby preventing the dispensing of pills 34 from the accessed counterbore. This also prevents refilling of the bores 30.

Figure 2:
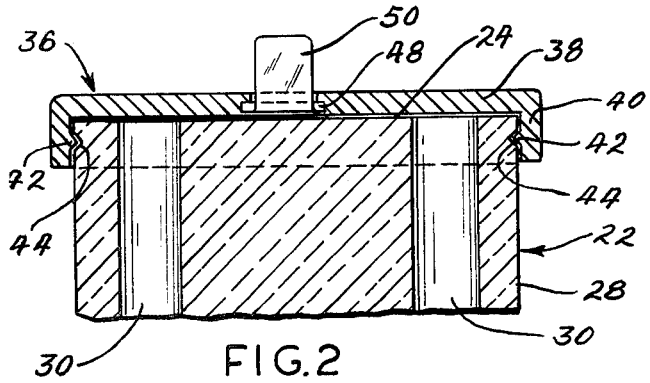
FIG. 2 is a fragmentary cross-sectional view taken along line 2—2 of FIG. 1.

FIG. 2 is a fragmentary view showing the relationship of the cap 36 on the container portion 22 enlarged for added clarity. Especially FIG. 2 shows how the cap 36 cooperatively engages the body portion 22 of the dispenser 20. The cap is preferably constructed of a stiff but somewhat resilient plastic material which enables the flange 40 to deflect and be snapped onto the body portion 22 as shown.

The cap 36', shown in FIG. 3, is similar to cap 26 but has a cut away portion 60 which is of a size to expose a selected one of the counterbores 30 in the container 22 depending on from which bore the next pill is to be taken. Note that with this construction there are three positions on the container portion 22 where the cutout 60 can be positioned in which none of the bores will be in registration with the cutout. Except for the differences between the caps 36 and 36' the construction and operation of the containers shown in FIGS. 1 and 3 are substantially the same.

Figure 4:
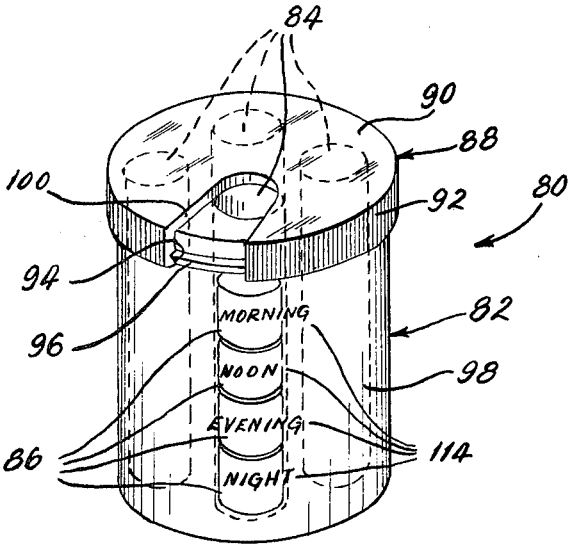
FIG. 4 is a perspective view, similar to FIG. 1, showing another embodiment of a pill dispenser constructed according to the present invention.

FIG. 4 shows another form of pill dispenser 80, which includes a container portion 82 similar to the container 22 of FIGS. 1–3, but having fewer bores for pills or tablets. In the embodiment of FIG. 4 the counterbores 84 are shown as being somewhat larger in diameter than the counterbores 30 and are adapted to hold larger pills or tablets 86. A cap 88, similar to the cap 36' of FIG. 3, is provided and has a round flat wall portion 90 with a depending flange 92 extending at right angles from the periphery thereof. The flange 92 in this case has an annular outwardly extending groove 94 formed on the interior surface thereof, and the groove cooperatively engages with an outwardly extending rib 96 of the same or similar shape formed on the outer surface of the container 82. This is the reverse of the groove and rib construction described above with respect to the dispenser 20 of FIGS. 1–3. The cap 88 has a cutout or notch 100 similar to the cutout 60 of the cap 36' of FIG. 3 for being selectively registered with one of the counterbores 84 depending on the position of the cap 88.

As shown in FIGS. 1, 3, and 4, indicia denoting the sequence in which the pills and tablets are to be dispensed may be inscribed or otherwise applied on the outer surface of the respective dispensers 20 and 80. Markings such as the indicia 110, 112, and 114 to indicate the times for taking a pill may be placed on the container, and such markings also serve to confirm whether the medication has been taken.

Dispensers such as those shown in FIGS. 1 and 3 are particularly useful for the dispensing of pills which are taken over extended time periods, such as birth control pills which are taken over a period of three menstrual cycles at the rate of one pill daily for 21 days of each menstrual cycle. In this case the indicia 110 and 112 denote the weeks and days on which pills are to be taken during each cycle, and they also indicate that during menses no pills are to be taken. Following the dispensing of the first week's supply the cap 36 is thereafter successively rotated to the second and third week positions thereby cycling through a first bore grouping containing a 21 day supply of pills to complete the first menstrual cycle. The second and third groupings of bores are accessed in succeeding menstrual cycles and pills are taken in accordance with the sequence indicated by the indicia associated with the dispenser. It is obvious that other arrangements and numbers of counterbores can be provided depending upon the kind and frequency of medication required. This means that the subject device can be used to enable persons to accurately keep track of a medication program that may extend over considerable periods of time and require regular or irregular periods between the times when medication is to be taken. The present means also makes it possible for the elderly and the mentally infirm, as well as others, to be able to take medication without difficulty on a complicated schedule and provides a means for quickly and easily verifying that the schedule is being followed.

The dispenser shown in FIG. 4 is more suited for the dispensing of medication such as analgesic diuretic preparations and the like. In this case the dispenser is adapted to hold tablets that are to be taken four times daily over a 4 day period. Indicia 114 associated with the container 82 indicate this by having on the container the words morning, noon, evening, and night at the appropriate locations, as shown. The dispensing of the medication from the dispenser 82 may be accomplished in a manner similar to that employed to dispense pills from the dispensers of FIGS. 1 and 3, as previously described. It is to be recognized, however, that the indicia shown in the several figures are illustrative only and that numerous types of indicia markings might be employed to indicate a particular pill-time sequence to be followed.

FIG. 5 shows still another dispenser 120 constructed according to the present invention which includes a tubular container 122, a rotatable closure cap 124, a bottom cap 126, and an insert 128. The container 122, being a tubular member, is open at both ends 128 and 130, and has a relatively thick wall portion 132 about a central cylindrical aperture or chamber 134 which extends therethrough. The wall portion 132 is thick enough to have a plurality of axial bores 136 positioned therein for holding the pills which are to be positioned therein. The closure cap 124 is adapted to fit on the end portion 128 of the container 122 and to be rotatable thereon to effect access to the bores 136 to permit pills to be dispensed therefrom. The insert 128 has indicia markings 138 extending as shown and is adapted to be inserted into the central aperture 134 extending through the tubular member 122, and the bottom cap 126 includes means such as circular plug 139 which makes frictional engagement with the lower end of the aperture 134 to hold the bottom closure 126 on the container and insert 128 in position in the aperture 134. The bottom closure 126 has a wall portion 140 which extends over the lower end of the container and blocks the lower ends of the bores 136. The container 122 is preferably sufficiently transparent to allow the indicia 138 appearing on the insert 128 to be seen through the wall portion 132 of the container 122. The insert 128 may be of any suitable material, such as plastic, thin metal, or paper, and preferably is of a tubular shape which occupies less than the entire volume of the aperture 134 thereby permitting the storage or deposit of additional materials within the aperture 134. For instance, such additional materials might include instructions relating to the pills or tablets, advertising information including Food and Drug Administration warnings, prescription information, additional pills for a later refill and so forth. The insert 128 may also be rotatable within the aperture 134 so that it may be repositioned to permit better viewing of the indicia thereon in relation to the pills, and the bottom cap 126 may be used to accomodate application of a pharmacy label, a precription, or number of various other information. Preferably, at least one of the end caps 124 and 126 will be relatively easily disengaged from the container 122 to permit filling and refilling.

To use the pill dispenser of the present invention one must first load it or it can be preloaded by the manufacturer or a pharmacist with pills or tablets of the type or types which are to be dispensed, such that the pills are properly ordered for dispensing in accordance with the sequence denoted by the pill-time correspondence indicia associated with the dispenser. Thereafter, dispensing is to proceed from the top to the bottom of a first bore before proceeding to dispensing from the next sequenced bore and so on. For filling, the top cap can be removed or can be rotated to access the bores for filling, as desired. With the embodiment shown in FIG. 5 it is also possible that the bottom cap may be removed instead to permit convenient bottom loading of the bores.

When all the prescribed pills or tablets have been loaded into the dispenser the removed cap is re-engaged with the container and is positioned thereon at a proper location depending on whether pills are to be dispensed or not, as explained. It is then a simple matter, taking into account the time schedule required, to reposition the cap, as necessary, to follow the schedule for taking medication. Some care must be taken when a bore is accessed and a pill is removed to make sure that no more than the required medication is removed. This is not usually a problem assuming reasonable care is used.

When the first accessed bore has been completely emptied of all pills, it will be neccessary to rotate the cap to access the next bore in sequence and so forth until all of the pills are taken, at which time the container can be refiled if necessary. If a transparent container is used the user will be able to view the remaining pills through the wall thereof and may, by noting the sequence and dosage indicating indicia, preferably located in close proximity to the pills in the accessed bore in order to permit an easily visible correspondence, determine when a pill was last taken, whether the proper number and type of pills were taken, and when the next pill or pills should be taken. The indicia associated with a dispenser thus not only indicate the sequence in which the pills are to be dispensed but also provide a visual pill-time correspondence that may be easily checked by the user.

It is recognized that indicia of many types and varieties may be employed, and that means may be provided for allowing the user or the person refilling the dispenser to alter the indicia so that they will conform with the particular pill-time correspondence sequence to be established. Thus, in a dispenser such as is shown in FIG. 5, a different insert may be employed or the indicia on an old one may be altered to reflect some change in the pill-time correspondence or a change in a prescription. Similarly with indicia applied to dispensers such as are shown in FIGS. 1–4, new indicia may be applied or the previous indicia may be altered, such as by removing gummed labels and applying new ones, and so forth.

It is to be noted that the present devices are relatively easy to make using known molding and extrusion techniques and known plastic and other substances. It is also to be noted that the present dispensers have many other possible applications and uses besides as a pill dispenser including providing an attractive, handy device for storing small parts and the like.

Thus there has been shown and described a novel pill or tablet dispenser which fulfills all the objects and advantages sought therefor. It will be apparent to those skilled in the art, however, that many changes, modifications, variations, and other uses and applications of the subject device are possible, and all such changes, modifications, variations, and other uses and applications which do not depart from the spirit and scope of the invention are deemed to be covered by the invention which is limited only by the claims which follow.

What is claimed is:

1. A dispenser for dispensing pills in a predetermined sequential order comprising, a cylindrical container having first and second end portions and an outer annular side wall portion extending therebetween, said container having a plurality of spaced annularly arranged axial bores extending thereinto from said first end portion, the space between two adjacent ones of said annularly arranged bores being greater than the space between other adjacent ones of said bores to define a blank station at said first end portion, each of said bores being adapted to hold a predetermined number of pills arranged in a column therein to be sequentially individually dispensed therefrom, means on the dispenser to indicate the pill status within the bores, a one-piece cap means engageable with said container adjacent said first end portion thereof and including means for cooperatively engaging with said container to permit relative rotational movement between said cap means and said container, said cap means having an opening therethrough registrable in one position only with said blank station to prevent dispensing of pills from any of said bores and registrable in different other selectable positions individually with each of the bores to permit dispensing of pills therefrom, said opening being formed by a cutout in the cap means, and a closure member slidably positioned in the cutout and movable in said cutout between a position closing the cutout and completely covering any bore in registration therewith to prevent dispensing of pills from said bore through said cutout and an open position wherein the cutout can be placed in registration with a selected bore to permit dispensing of pills therefrom.

2. The dispenser of claim 1 wherein said container is transparent to permit the pills in said bores to be seen.

3. The dispenser of claim 1 wherein said cooperatively engageable means include an annular groove formed in one of said relatively movable portions and means engageable with said groove on the other.

4. The dispenser defined in claim 1 wherein the pill status indication means include pill sequence indicating means formed on the outer annular side wall portion of the container.

5. The dispenser defined in claim 1 wherein said container has a centrally located chamber extending between said first and second end portions, and the pill status indication means include an insert adapted to be positioned in said aperture.

6. The dispenser defined in claim 5 wherein said centrally located chamber is open ended, said cap means closes one end of said chamber, and said dispenser includes a second cover member engageable with said container adjacent the opposite end of the chamber from the cap means to complete the enclosing of the chamber.

7. The dispenser defined in claim 5 wherein said chamber is a right cylindrical chamber.

8. The dispenser defined in claim 7 wherein said bores are right cylindrical bores, the diameter of said centrally positioned cylindrical chamber is larger than the diameter of said bores, and said first insert occupies substantially less than the volume of said chamber so that additional items may be inserted therein.

9. The dispenser defined in claim 1 wherein said cap means are rotatable on the container to move said opening into registration with a selected bore to permit pills to be sequentially dispensed therefrom and thereafter into registration individually with the other bores to permit pills therein to be sequentially dispensed therefrom.

10. The dispenser defined in claim 1 wherein said cap means includes a wall portion with a depending peripheral flange, said flange being formed of a resilient material enabling it to be deflected to engage the container.

11. A dispenser for dispensing tablets in a predetermined sequential order comprising a one-piece cylindrical container body having first and second end portions with an outer annular side wall portion extending therebetween, said first end portion having a plurality of spaced annularly arranged axial apertures extending thereinto, each of said apertures having an open dispensing end with the space between a selected pair of adjacent apertures defining a blank station on said first end portion, said blank station being at least as wide as the diameter of one of said apertures, each of said apertures being of a size to receive a plurality of tablets stackedly arranged in a single column therein to be sequentially individually dispensed therefrom, said container body being constructed to permit the tablet status in said apertures to be determinable by visual inspection, cap means including an end wall and a peripheral flange extending therefrom, said flange and said container body having cooperatively engageable means which permit relative rotational movement therebetween, an opening through said cap means in position to register only with said blank station in one relative position of the cap means on the container body to cause said end wall to cover all said open dispensing ends of said apertures and to register with said apertures individually in other different relative positions of the cap means on the container body to permit dispensing of tablets therefrom, a member slideable in the opening in said cap means, said slideable member being movable between a first position to permit pills to be dispensed through the opening and a second position closing the opening and preventing the dispensing of said pills, and means on the dispenser for indicating the sequence in which the tablets are to be dispensed.

12. The dispenser of claim 11 wherein said container is formed of light conducting material to permit the tablets in the apertures to be seen.

13. The dispenser defined in claim 11 wherein said container has an annular radially projecting flange formed on the outer annular side wall portion thereof and said cap means includes means cooperatively engageable with said flange to permit relative movement therebetween.

14. A dispenser for dispensing pills in a predetermined sequential order comprising, a cylindrical container having first and second end portions and an outer annular side wall portion extending therebetween, said container having a plurality of spaced annularly arranged axial bores extending thereinto from said first end portion, said bores being arranged in groups with spaces between adjacent groups that are greater than the space between adjacent ones of said annularly arranged bores in each group to define blank stations at said fisrt end portion, each of said bores being adapted to hold a predetermined number of pills arranged in a column therein to be sequentially individually dispensed therefrom, means on the dispenser to indicate the pill status within the bores, said means including a bore located centrally in the container between the annularly arranged bores and an insert in said centrally located bore having means thereon that are visible in the blank stations between the groups of bores to indicate the pill status of the bores in said groups, a one-piece cap means engageable with said container adjacent said first end portion thereof and including means for cooperatively engaging with said container to permit relative rotational movement between said cap means and said container, said cap means having an opening therethrough registrable in different positions with each of said blank stations to prevent dispensing of pills from any of said bores and registrable in different other selectable positions individually with each of the bores to permit dispensing of pills therefrom.

15. The dispenser of claim 14 wherein said wall is formed of a transparent substance.

16. The dispenser defined in claim 14 including means associated with the second end of said tubular member to seal the vores thereat said means including a second closure member engageable with said tubular member adjacent to said second end.

17. The dispenser defined in claim 14 wherein said insert occupies a relatively small space in the tubular member.

18. The dispenser defined in claim 14 wherein one of said closure members is relatively flexible.

19. The dispenser defined in claim 14 wherein said bores extend through the wall of said tubular member between the first and second ends thereof.

20. A pill dispenser for use in dispensing pills on a schedule over an extended period, said dispenser including, a container member having a surface portion with a plurality of bores extending thereinto, the depth of each of said bores being less than the depth of said container member, said bores being in an annular arrangement with the space between two adjacent bores of said bores being greater than the space between at least two other adjacent ones of said bores to define a blank station on said surface portion, each of said bores being of a size to hold a plurality of pills arranged in a column therein to be individually sequentially dispensed therefrom, a closure member mounted on said container member, said closure member having a round portion positioned adjacent to the surface portion of said container member and extending over said surface portion to cover said bores, an opening through said closure member, cooperatively engageable means on said container member and on said closure member permitting relative movement therebetween whereby the opening can be sequentially placed in registration individually with said blank station and with each of said bores to permit sequential dispensing of individual pills from each of said bores, and, means in the closure member positioned for movement in the opening therein, said means being movable between a first position closing the opening to prevent dispensing therefrom and completely covering any bores in registration with said opening and a second position opening the opening.

* * * * *

UNITED STATES PATENT OFFICE

CERTIFICATE OF CORRECTION

Patent No. 4,127,190 Dated November 28, 1978

Inventor(s) Robert M. Sunnen

It is certified that error appears in the above-identified patent and that said Letters Patent are hereby corrected as shown below:

Column 4, line 11 "cap 26" should be
---cap 36---

Column 8, line 8 cancel "first"

Column 9, line 12 "fisrt" should be
---first---

Column 9, line 40 "vores" should be
---bores---

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*